US005680979A

United States Patent [19]

Weis

[11] Patent Number: 5,680,979

[45] Date of Patent: Oct. 28, 1997

[54] DRAWING ROLLER DRIVE

[75] Inventor: Anton Weis, Lorsch, Germany

[73] Assignee: Koenig & Bauer-Albert Aktiengesellschaft, Wurzburg, Germany

[21] Appl. No.: 577,881

[22] Filed: Dec. 22, 1995

[30] Foreign Application Priority Data

Dec. 29, 1994 [DE] Germany ..... 44 47 089.4

[51] Int. Cl.[6] ..... B41F 13/02; B65H 23/192

[52] U.S. Cl. ..... 226/111; 226/178; 226/188; 475/214

[58] Field of Search ..... 226/24, 111, 118, 226/178, 112, 188; 475/338, 341, 342, 214

[56] References Cited

U.S. PATENT DOCUMENTS

| | | | |
|---|---|---|---|
| 1,859,899 | 5/1932 | Thellmod et al. | 475/214 |
| 2,334,074 | 11/1943 | Coy | 226/178 |
| 3,090,258 | 5/1963 | Zink et al. | 475/338 |
| 3,410,146 | 11/1968 | Nordeen | 475/214 |
| 3,705,522 | 12/1972 | Ogawa | 475/341 |
| 3,727,474 | 4/1973 | Fullerton | 475/214 |
| 3,739,658 | 6/1973 | Scheiter | 475/214 |
| 3,792,629 | 2/1974 | Applebury | 475/342 |
| 3,808,913 | 5/1974 | Gilbert et al. | 475/338 |
| 5,318,486 | 6/1994 | Lutz | 475/214 |
| 5,480,362 | 1/1996 | Tanaka et al. | 475/338 |

FOREIGN PATENT DOCUMENTS

| | | | |
|---|---|---|---|
| 23 28 949 | 1/1975 | Germany . | |
| 4133962 | 4/1993 | Germany | 475/338 |
| 6137401 | 5/1994 | Japan | 475/214 |
| 1657808 | 6/1991 | U.S.S.R. | 475/338 |

*Primary Examiner*—Daniel P. Stodola
*Assistant Examiner*—Matthew A. Kaness
*Attorney, Agent, or Firm*—Jones, Tullar & Cooper, P.C.

[57] ABSTRACT

A drawing roller drive for the conveyance of a web in a rotary printing press utilizes a differential gear to accomplish a very exact change in the speed of the drawing roller. A single drive shaft and a single power take-off shaft are aligned coaxially with respect to each other. The differential gear arrangement includes a ball race gear and a downstream tension shaft gear.

5 Claims, 3 Drawing Sheets

DRAWING ROLLER DRIVE

FIELD OF THE INVENTION

The present invention is directed generally to a drawing roller drive. More particularly, the present invention is directed to a drawing roller drive for the controllable conveyance of a web in a rotary printing press. Most specifically, the subject invention is directed to a controllable drawing roller drive having a very exact constant gear ratio which can be continuously very finely adjusted. A gear, which is embodied as a differential gear, is situated between the drawing roller and a press drive, such as a longitudinal shaft. The drawing roller drive includes a drive shaft that is driven by the longitudinal shaft, and a power take-off shaft that is used to drive the drawing roller. These two shafts are situated coaxially with respect to each other. The roller drive affords very fine adjustment of the speed of the drawing roller with respect to the press drive.

DESCRIPTION OF THE PRIOR ART

In various applications in the rotary printing art, as well as in other areas, it is necessary to control the drive speed of a cylinder which is being driven from a central drive shaft. In rotary printing presses the main press drive frequently is a longitudinally extending shaft that carries various bevel gears and other drive gears. These gears are used to provide the motive power to the large number of cylinders which are used in the rotary printing press. While the rotational speed of each cylinder or roller is a function of the speed of the main press drive and the gear assembly between the main drive and the cylinder or roller, it is frequently very desirable to be able to change or adjust the speed of the cylinder or roller drive with respect to the press drive without stopping the press and changing gear sets. Such a fine adjustment has been accomplished by the use of a differential gear.

One differential gear that is usable in a rotary printing press is described in German published, non-examined patent application No. DE-OS 23 28 949. The device described in this document provides for the drive of cylinders affecting paper tension by means of a differential gear. This differential gear is designed as a tension shaft gear wherein a tension shaft generator can be braked by use of a magnetic brake.

A limitation of this prior art device is that the constant RPM of the cylinder can only be maintained by means of a large control effort for the brake. Such a device is apt to be rather large and expensive. Additionally, the control provided by this prior art differential gear arrangement may not be as accurate as desired.

It will thus be seen that a need exists for a controllable drive gear arrangement which overcomes the limitations of the prior art devices. The drawing roller drive in accordance with the present invention provides such a device and is a significant improvement over the prior art.

SUMMARY OF THE INVENTION

It is an object of the present invention to provide a drawing roller drive.

Another object of the present invention is to provide a drawing roller drive for the controllable conveyance of a web in a rotary printing press.

A further object of the present invention is to provide a controllable drawing roller drive having a very exact constant gear ratio which can be continuously very finely adjusted.

Still another object of the present invention is to provide a drawing roller drive by use of a differential gear.

Yet a further object of the present invention is to provide a drawing roller drive having a single drive shaft and a single power take-off shaft with these shafts being arranged coaxially with respect to each other.

As will be discussed in detail in the description of the preferred embodiment which is presented subsequently, the drawing roller drive in accordance with the present invention utilizes a differential gear that is disposed between the drawing roller and a longitudinal shaft that carries a drive gear. A ball race gear is driven from the longitudinal shaft through an arrangement of bevel gears. This ball race gear is used to drive a tension shaft gear which is connected to the drawing roller whose speed of rotation is to be controlled or adjusted. The ball race gear includes several drive ball races, a set collar and a power take-off ball race. The set collar can be shifted axially and this shifts the transfer balls which are a part of the ball race gear. The power take-off ball race is connected with the tension shaft gear through an elliptical cam disk, a plurality of rollers and an elastic planetary wheel. Rotation of the elliptical cam disk will cause the elastic planetary wheel to change its radial size and orientation and to thereby vary its driving contact with the drive for the power take-off shaft.

The drawing roller drive shaft in accordance with the present invention overcomes the limitations of the prior art devices. The differential gear arrangement uses much less space than was required by the prior devices. This is due in part to the coaxial alignment of the drive and the power take-off shafts, as well as to the omission of the elaborate reversing or intermediate guide gears. The ball race gear, which is used in the subject invention, also allows for the adjustment of the gear ratio of the drawing roller drive when the rotary printing press is stopped. This means that the gear ratio can be properly set during a stoppage of the printing press to duplicate a setting made in accordance with the production requirements of, for example, a repeat order. The ball race gear used in the present invention transmits the rotary motion from the drive shaft to the power take-off shaft by rolling contact which generates only minimal wear. A tension shaft gear makes possible large gear ratios in a very small space. Furthermore, in comparison with, for example, conventional planetary gear wheels, the RPM of the planetary gear wheel is lower and the contact ratio is very high, which is an arrangement that results in reduced wear.

The drawing roller drive in accordance with the present invention is particularly advantageous because it provides for a very exact constant ratio which can be continuously very finely adjusted. No additional drives or brakes are required for operating the drawing roller drive.

The drawing roller drive in accordance with the present invention overcomes the limitations of the prior art devices. It is a substantial advance in the art.

BRIEF DESCRIPTION OF THE DRAWINGS

While the novel features of the drawing roller drive in accordance with the present invention are set forth with particularity in the appended claims, a full and complete understanding of the invention may be had by referring to the detailed description of the preferred embodiments which is presented subsequently, and as illustrated in the accompanying drawings, in which:

DETAILED DESCRIPTION OF THE PREFERRED EMBODIMENTS

Figure 1:
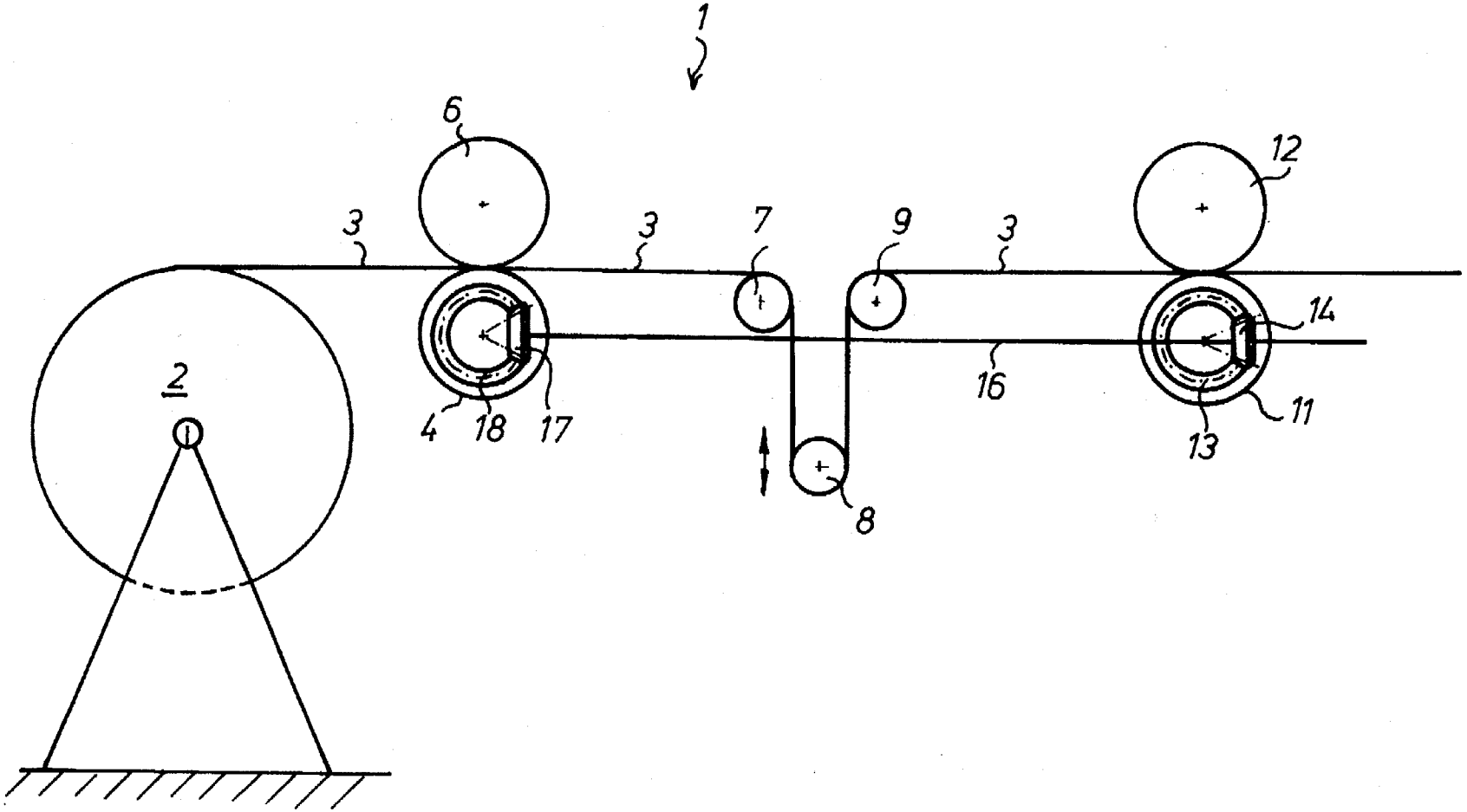
FIG. 1 is a schematic side elevation view of a draw-in unit of a rotary printing press in which the drawing roller drive for the present invention finds use.

Referring initially to FIG. 1, there may be seen a draw-in unit of a rotary printing press, generally at 1, in which the drawing roller drive of the present invention is used. A web 3 of a flexible material, such as paper, plastic or fabric, for example, is fed to the draw-in unit 1 of a rotary printing press from a roll 2 of the material. The web 3 is guided in the draw-in unit 1 and passes between a first drawing roller 4 and a spring-mounted first pressure roller 6. From there, web 3 passes to a first guide roller 7 which deflects the web 3 by approximately 90° toward a movable compensating roller 8. The web 3 loops around the compensating roller through approximately 180°, and the compensating roller thus controls the web tension by means of its position. From the compensation roller 8, the web 3 passes over a second guide roller 9, which again deflects the web 3 by approximately 90° and brings it to a second drawing roller 11. The web 3 is guided between this drawing roller 11 and a second pressure roller 12 and is conveyed to other units, not shown. This arrangement is generally known in the art and forms no part of the invention. It will be understood that this draw-in unit 1 is exemplary of various such units with which the drawing roller drive of the present invention can be used.

The drive of the second drawing roller 11 is accomplished by use of a bevel gear wheel 13 which is connected with the drawing roller 11 and which is in gear drive engagement with a bevel gear wheel 14 that is secured to a longitudinal shaft 16. The longitudinal shaft 16 is driven by a portion of the press drive, that is not shown.

Figure 2:
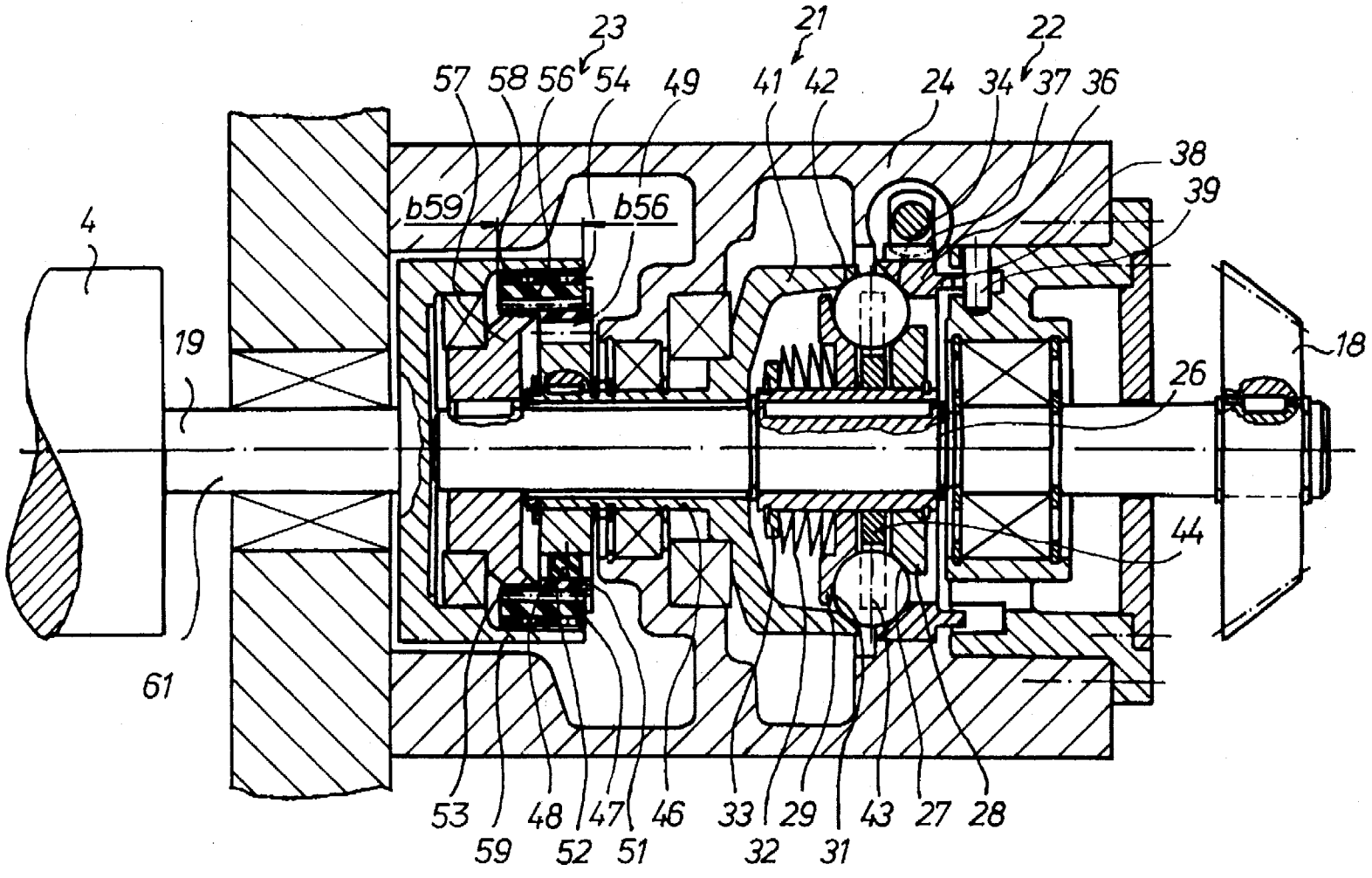
FIG. 2 is a sectional view of a first preferred embodiment of the drawing roller drive in accordance with the present invention.
Figure 3:
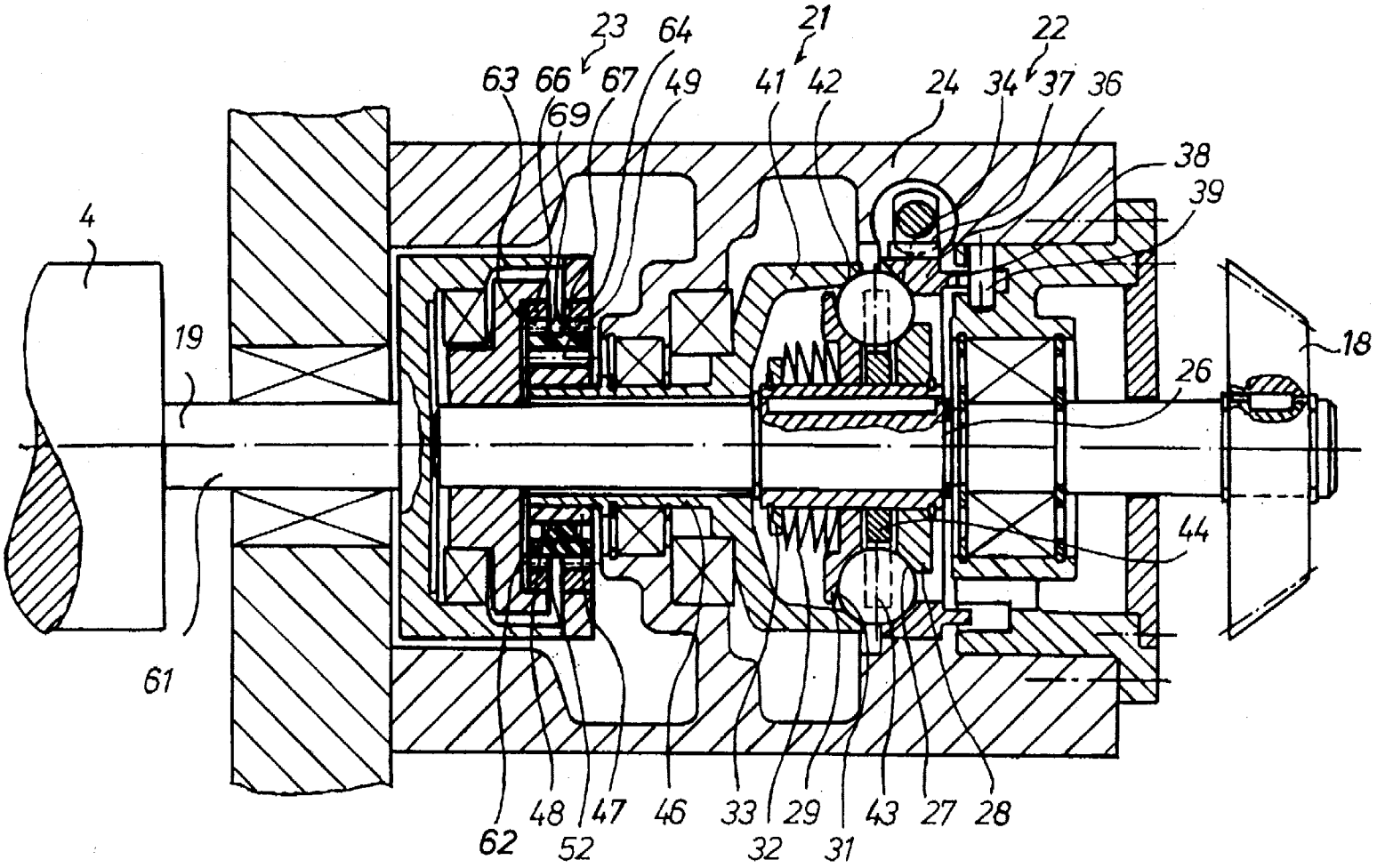
FIG. 3 is a sectional view of a second preferred embodiment of the drawing roller drive of the present invention.

A similar bevel gear wheel 17 is located on the longitudinal shaft 16, and is associated with a bevel gear wheel 18 that is used to drive the first drawing roller 4. A fine adjustment gear, as may be seen generally at 21 in FIGS. 2 and 3, is situated between this bevel gear wheel 18 and a journal 19 of the drawing roller 4. The fine adjustment gear 21 in accordance with the present invention can also be interposed at other locations between the drawing roller 4 and the drive, for example in the longitudinal shaft or in vertical shafts in connection with other configurations which are not specifically shown.

The fine adjustment gear 21 is comprised generally of a friction gear with a continuously adjustable transmission with an integrated overlay gear. The friction gear is designed as a ball race gear 22 and the overlay gear as a tension shaft gear 23 with a gear ratio i23, for example i23=32.

Referring now primarily to FIG. 2, which shows a first preferred embodiment of a drawing roller drive in accordance with the present invention, a drive shaft 26 is rotatably and axially immovably seated in a housing 24 of the fine adjustment gear 21. A first drive ball race 28 is provided with a concentric, flat pitch surface 27. This race 28 is fastened in a torsion-proof manner on this drive shaft 26. A second drive ball race 29, which has a concentric concave pitch surface 31, is located axially opposite this first drive ball race 28, and is axially displaceable on shaft 26 by means of plate springs 32 which act together with a stop 33 which is fixed in respect to the drive shaft 26. A set collar 36, that is provided with a flat pitch surface 34, is displaceable in the axial direction of shaft 26 and is disposed in the housing 24 concentrically with the first drive ball race 28. The axial displacement of the set collar 36 is provided by the provision of a set cam 37 that is rotatable and which will cause a rotation of the set collar 36 in the circumferential direction. Wedge-shaped surfaces 38 are disposed along the circumference of this set collar 36, and act together with bearing bolts 39 fixed on the housing. A fourth power take-off ball race 41, which is rotatable in respect to the drive shaft 26, but which is axially rigid, is disposed opposite the set collar 36 and is also provided with a concentric flat pitch surface 42. A number of transfer balls 43, which are spaced apart from each other by means of a cage 44, are disposed on a circular path between these drive ball races 28, 29, 36 and 41. Each one of the transfer balls 43 touches each one of the four pitch surfaces 27, 31, 34 and 42 of the four drive ball races 28, 29, 36 and 41, respectively.

The power take-off ball race 41 is fastened on a hollow shaft 46 which, as may be seen in FIG. 2, is located concentrically in respect to the drive shaft 26. The power take-off ball race 41 and the hollow shaft 46 are seated in the housing 24, and are freely rotatable, with respect to the drive shaft 26, by means of a bearing. An elliptical cam disk 47 of the tension shaft gear 23 is rotatably fastened at a free end of the hollow shaft 46 which is opposite to the power take-off ball race 41.

A plurality of cylinder rollers 49, which are enclosed in an elastic thin ring 51 and which are spaced from each other by an also elastic cage 52, roll on an outer jacket surface 48 of this elliptical cam disk 47. The elastic ring 51 supports an elastic planetary wheel 56, which is provided with interior and exterior teeth 53 and 54, respectively and which has a width b56. The elastic ring 51 contacts the interior teeth 53 of the planetary wheel 56 in two oppositely located areas along approximately one half of the width b56 of the interior teeth 53. The interior and exterior teeth 53 and 54 of the elastic planetary wheel 56 have the same number of teeth z56, for example z56=130. A spur wheel 57 with exterior teeth with a number of teeth z57, for example z57=128, engages the remaining half of the width of the interior teeth 53. This spur wheel 57 is rigidly connected with the drive shaft 26.

The exterior teeth 54 of the elastic planetary wheel 56 roll inside inner teeth 58 of a sun wheel 59 with a number of teeth z59, for example z59=132, and of a width b59 corresponding to the width b56 of the planetary wheel. This sun wheel 59 is fastened on a power take-off shaft 61, which is continued as the journal 19 of the drawing roller 4 and rotates at a power take-off rpm n61.

The operation of the first preferred embodiment of the drawing roller drive in accordance with the present invention will now be discussed in detail. If, in order to change the tension of the web 3, the compensation roller 8 changes its position, or if the web 3 is stretched in the area between the two drawing rollers 4 and 11, it becomes necessary to change an rpm ratio between the two drawing rollers 4 and 11. To do this in accordance with the subject invention, the rpm of the first drawing roller 4 is changed by means of the fine adjusting gear 21. The drive rpm n26 is supplied to the drive shaft 26 by means of the bevel wheel 18 fastened on the drive shaft 26. This causes the two drive ball races 28 and 29 to rotate at the drive speed n26. The transfer balls 43 are supported on the set collar 36 and by their rolling movement transfer a rotary movement to the power take-off ball race 41. An rpm n41 of the power take-off ball race 41 is determined by means of the position of the transfer balls 43 with respect to the pitch surfaces 27, 31, 34 and 42 of the drive ball races 28, 29, 36 and 41, respectively. To change the rpm n41 of the power take-off ball race 41, the set cam 37 is displaced tangentially with respect to the set collar 36 by means of an adjusting drive, not shown, which may be, for example, an electric motor. The tangential displacement of the set cam 37 by operation of the adjusting device causes the set collar 36 to be displaced in the circumferential direction. The wedge-shaped surfaces 38 acting together with the bearing bolts 39 therefore cause an axial displacement of the set collar 36 during the turning of the set collar 36. This results a changed axial position of the drive ball race 29, which is made possible because of the elasticity of the plate springs 32. The axial position of the transfer balls 43 is changed by this shifting of the set collar 36. The ball race gear 22 permits a continuous change of the gear ratio from the rpm n41 of the power take-off ball race 41, and therefore that of the hollow shaft 46, over a range from 0 to 0.4×n26.

The cam disk 47 which is rigidly connected with the power take-off ball race 41 turns at an rpm n47 which is equal to rpm n41. This rotary movement is transmitted as a radial movement to the elastic planetary wheel 56 by operation of the cylinder rollers 49 rolling off on the cam disk 47 and the elastic ring 51. The elastic planetary wheel 56 is radially deformed by the shifting of the cylinder rollers and therefore partially changes its diameter.

The positions of the interior and exterior teeth 53 and 54 of the planetary wheel 56 will be changed because of this deformation of the elastic planetary wheel 56 so that the exterior teeth 54 of wheel 56 are in full contact with the interior teeth 58 of the sun wheel 59 at the highest or greatest radius areas of the elliptical cam disk 47, and the interior teeth 53 of the planetary wheel 56 do not engage the spur wheel 57 at this point. In the lowest or least radius areas of the elliptical cam disk 47, the interior teeth 53 of the planetary wheel 56 are in engagement with the spur wheel 57, and the exterior teeth 54 of the planetary wheel 56 do not engage the interior teeth 53 of the sun wheel 59. Between these two extremes, areas of the planetary wheel 56 act together with or engage the sun wheel 59 as well as the spur wheel 57. The areas of engagement between the planetary wheel 56, the spur wheel 57 and the sun wheel 59 migrate because of the radial deformation of the elastic planetary wheel 56 by means of the rotation of the elliptical cam disk 47. The resultant effect of this is that a relative rotation between the spur wheel 57 and the sun wheel 59, which is a function of the relative rpm of the cam disk 47 with respect to the planetary wheel 56 and in accordance with the relationship $n61=n41/(i23+1)+(n26\times i23)/(i23+1)$, is achieved.

In the first preferred embodiment depicted in FIG. 2, the planetary gear 56 is employed as a differential gear. This results in an rpm ratio of the drive rpm n26 of the drive shaft 26 with respect to the power take-off rpm n61 of the drive shaft 61 as a function of the rpm n41 of the power take-off ball race 41 and therefore of the cam disk 47.

In a second preferred embodiment, as is shown in FIG. 3, the tension shaft gear, generally at 23, essentially consists of the elliptical cam disk 47 with an elastic planetary wheel 62 seated on cylinder rollers 49, and two sun wheels 66 and 67 that are provided with interior teeth 63 and 64, respectively. The first sun wheel 66 is connected in a torsion-proof manner with the drive shaft 26, and the second sun wheel 67 is connected with the power take-off shaft 61, also in a torsion-proof manner. The elastic planetary wheel 62 has exterior teeth 69 which act together with the interior teeth 63 of the sun wheel 66 as well as with the interior teeth 64 of the sun wheel 67.

In this second preferred embodiment, the elliptical cam disk 47 rotates at an rpm determined by the ball race gear 22, and because of this the position of the high areas of the cam disk 47 is changed. The elastic planetary wheel 62 is moved in the circumferential direction by the sun wheel 66 and is radially deformed by the elliptical cam disk 47. The result of this is that a relative motion of the planetary wheel 62 with respect to the first sun wheel 66, as well as of both sun wheels 66 and 67 with respect to each other, is generated. The desired rpm ratio of the drive rpm n26 of the drive shaft 26 in respect to the power take-off rpm n61 of the power take-off shaft 61 is achieved in this way.

A control range results, by means of the combination of the ball race gear 22 with the tension shaft gear 23 of the fine adjustment gear, for example in the present first embodiment of the power take-off rpm n61 of the power take-off shaft 61 of $n61=0.97\times n26$ to $n61=0.98\times n26$ of the drive rpm n26 of the drive shaft 26.

While preferred embodiments of the drawing roller drive in accordance with the present invention have been set forth fully and completely hereinabove, it will be apparent to one of skill in the art that a number of changes in, for example, the overall sizes of the cylinders, the type of press being used, the drive for the longitudinal shaft and the like could be made without departing from the true spirit and scope of the present invention which is accordingly to be limited only by the following claims.

What is claimed is:

1. A drive for a drawing roller usable for the controllable conveyance of a web in a rotary printing press, said drive comprising:

a drive shaft driven by a main press drive of the rotary printing press at a fixed drive shaft speed and having a drive shaft axis of rotation;

a drawing roller power take-off shaft driven from said drive shaft at a variable speed and having a drawing roller power take-off shaft axis of rotation, said drive shaft and said power take-off shaft being situated coaxially with respect to each other; and a differential gear disposed between, and connecting said drawing roller power take-off shaft and said drive shaft, said differential gear including a ball race gear connected to said drive shaft, said ball race gear including an axially shiftable set collar and a set cam, and a tension shaft gear connected to said drawing roller power take off shaft, said ball race gear being driven by said drive shaft and driving said power take-off shaft through said tension shaft gear, said set collar being axially shiftable by actuation of said set cam to change said variable speed of said drawing roller power take-off shaft with respect to said fixed drive shaft speed.

2. A drive for a drawing roller usable for the controllable conveyance of a web in a rotary printing press, said drive comprising:

a drive shaft driven by a main press drive of the rotary printing press;

a drawing roller power take-off shaft; and a differential gear disposed between, and connecting said drawing roller power take-off shaft and said drive shaft, said differential gear including a ball race gear connected to said drive shaft and a tension shaft gear connected to said drawing roller power take off shaft, said ball race gear engaging said tension shaft gear, said ball race gear including first and second drive ball races, a set collar, a power take-off ball race and a plurality of transfer balls, said first and second drive ball races being fastened to said drive shaft, said power take-off ball race being connected with said tension shaft gear, said set collar being supported by said drive shaft for axial movement with respect to said drive shaft, and said transfer balls being supported by said first and second drive ball races, said set collar and said power take-off ball race.

3. The drive for a drawing roller in accordance with claim 2 wherein said tension shaft gear includes an elliptical cam disk, an elastic planetary wheel with exterior and interior teeth, a spur wheel with exterior teeth, and a sun wheel, said elastic planetary wheel being indirectly connected to said drive shaft through said elliptical cam disk which is connected to said power take-off ball race and to said spur wheel, said sun wheel being connected with said drawing roller by said power take-off shaft.

4. The drive for a drawing roller in accordance with claim 3 wherein said spur wheel is fastened on said drive shaft.

5. The drive for a drawing roller in accordance with claim 2 wherein said tension shaft gear includes an elliptical cam disk, an elastic planetary wheel with exterior teeth, and first and second sun wheels having interior teeth, said first sun wheel being connected to said drive shaft and said second sun wheel being connected with said power take-off shaft connected to said drawing roller, said elliptical cam disk being connected to said power take-off ball race of said ball race drive.

* * * * *